US008413675B2

(12) United States Patent
Cantrell

(10) Patent No.: US 8,413,675 B2
(45) Date of Patent: Apr. 9, 2013

(54) YARD HYDRANT MADE EASY

(76) Inventor: Kevin Cantrell, Salem, IL (US)

( * ) Notice: Subject to any disclaimer, the term of this patent is extended or adjusted under 35 U.S.C. 154(b) by 181 days.

(21) Appl. No.: 13/012,154

(22) Filed: Jan. 24, 2011

(65) Prior Publication Data

US 2011/0186145 A1 Aug. 4, 2011

Related U.S. Application Data

(60) Provisional application No. 61/300,818, filed on Feb. 2, 2010.

(51) Int. Cl.
*E03B 9/02* (2006.01)

(52) U.S. Cl.
USPC ..... 137/301; 137/281; 137/798

(58) Field of Classification Search ..... 137/301, 137/302, 272, 281, 798
See application file for complete search history.

(56) References Cited

U.S. PATENT DOCUMENTS 6,321,773 B1 * 11/2001 Ramsby ..... 137/209
6,684,900 B1 * 2/2004 McKeague ..... 137/301

* cited by examiner

*Primary Examiner* — Kevin Lee
(74) *Attorney, Agent, or Firm* — Tipton L. Randall

(57) ABSTRACT

A Yard Hydrant Made Easy has a riser with a slip connection, called a pitless adapter, attached directly to the side of the riser, below freeze level. The water supply is connected to the outside section of the pitless adapter and a yard hydrant is attached to the inside removable section of the pitless adapter. This hollow riser and slip connection allows for easy removal and replacement of a yard hydrant, without the need of any future excavation, busting of concrete, or tearing up of landscaped areas. A seepage section may be incorporated at the base of the riser to allow a yard hydrant to drain out without ever coming in contact with soil. This prevents any chance of the drain hole, at the base of the yard hydrant, becoming stopped up and causing the hydrant to freeze. A dual check valve backflow preventer may be installed at the base of the hydrant. An underground shut-off valve may be connected to the outside section of the pitless adapter to allow the individual hydrant to be isolated without interrupting water supply to an entire property.

6 Claims, 5 Drawing Sheets

(BOTTOM VIEW)

YARD HYDRANT MADE EASY

CROSS-REFERENCE TO RELATED APPLICATIONS

This application claims the benefit of priority from U.S. provisional patent application No. 61/300,818, filed Feb. 2, 2010, the contents of which are herein incorporated by reference.

BACKGROUND OF THE INVENTION

The present invention relates to yard hydrants and, more particularly, to yard hydrants disposed in a buried housing with a slip together adapter that allows for replacement of the yard hydrant without excavation.

When a yard hydrant is installed, a hole is dug in the ground to below the freeze level and the hydrant is connected to a water line at that level. When the hydrant needs to be replaced, it has to be dug up again to connect a new hydrant to the existing water line. Current devices require the installer of a replacement hydrant to unscrew the old and then re-thread the new hydrant onto its fitting at the bottom of the riser. There is no way to give back-up support to this underground fitting while either unscrewing the old or re-threading the new hydrant onto this underground fitting, causing the chance of breakage. Also, with this fitting being several feet underground, the chance of cross-threading the fitting exists during the replacement process.

A yard hydrant has a hole at its base to allow water to drain out of its riser to keep the hydrant from freezing when in the off position during cold weather. This hole is susceptible to stopping up with dirt and debris. Current devices do not provide a separate seepage area or incorporate the use of a backflow preventer or isolation valve.

As can be seen, there is a need for a Yard Hydrant Made Easy that may allow for easy replacement of a yard hydrant, without the need to dig up the old hydrant or thread a new hydrant from a distance from a fitting. Moreover, there is a need for a Yard Hydrant Made Easy that may drain water when not in use, where the drain may not readily clog.

SUMMARY OF THE INVENTION

In one aspect of the present invention, a Yard Hydrant Made Easy comprises a casing disposed in ground, the casing extending from a surface of the ground into the ground; a riser adapted to be disposed in the casing; a pitless adapter having a stationary component attached to the casing, the stationary component permitting a fluid connection from outside the casing to inside the casing; a water supply line attached to the stationary component outside the casing; and a removable component of the pitless adapter fluidly connected to the riser.

These and other features, aspects and advantages of the present invention will become better understood with reference to the following drawings, description and claims.

DETAILED DESCRIPTION OF THE INVENTION

Figure 1:
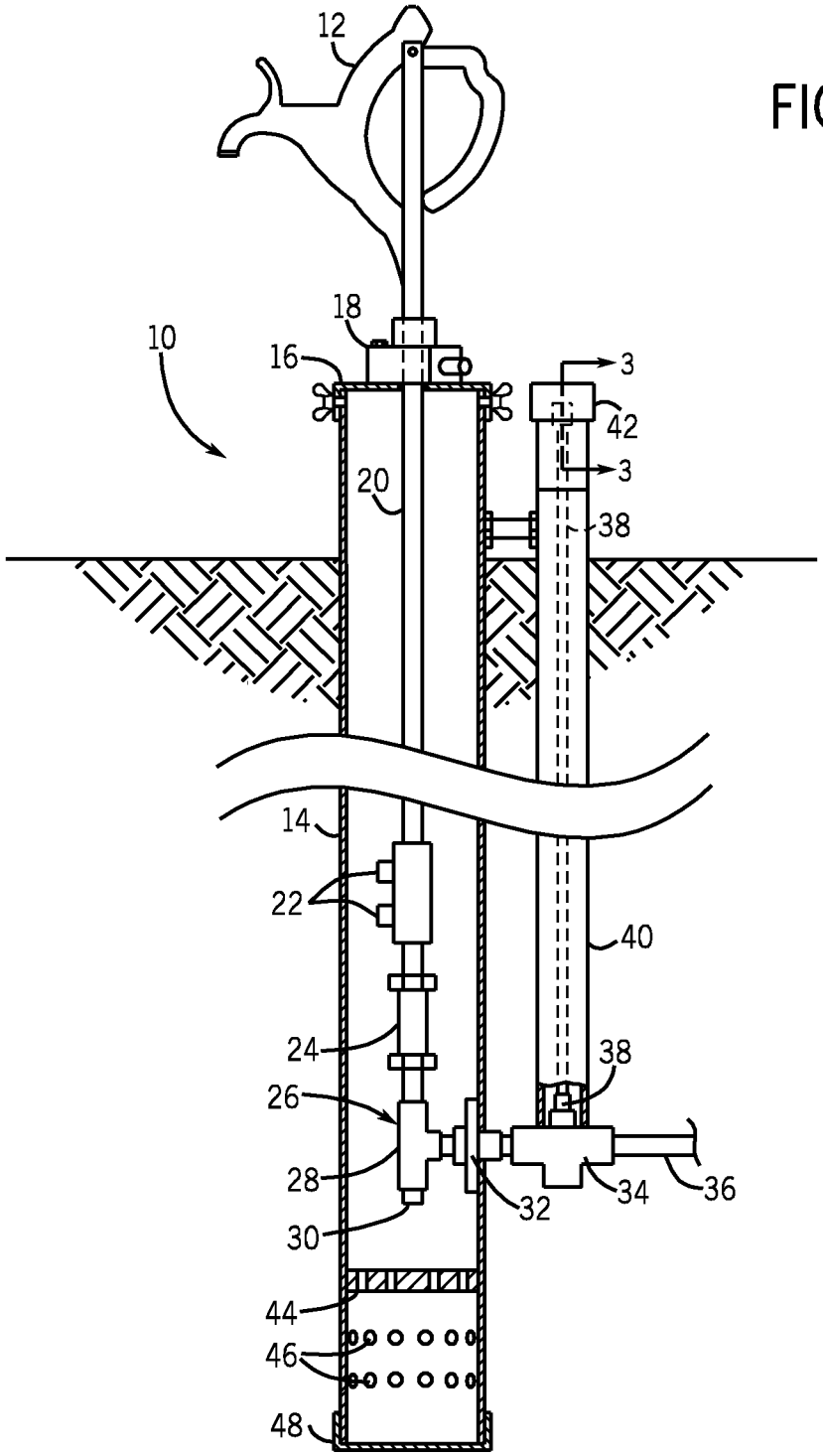
FIG. 1 is a cross-sectional view of a Yard Hydrant Made Easy with a yard hydrant installed according to an exemplary embodiment of the present invention.
Figure 2:
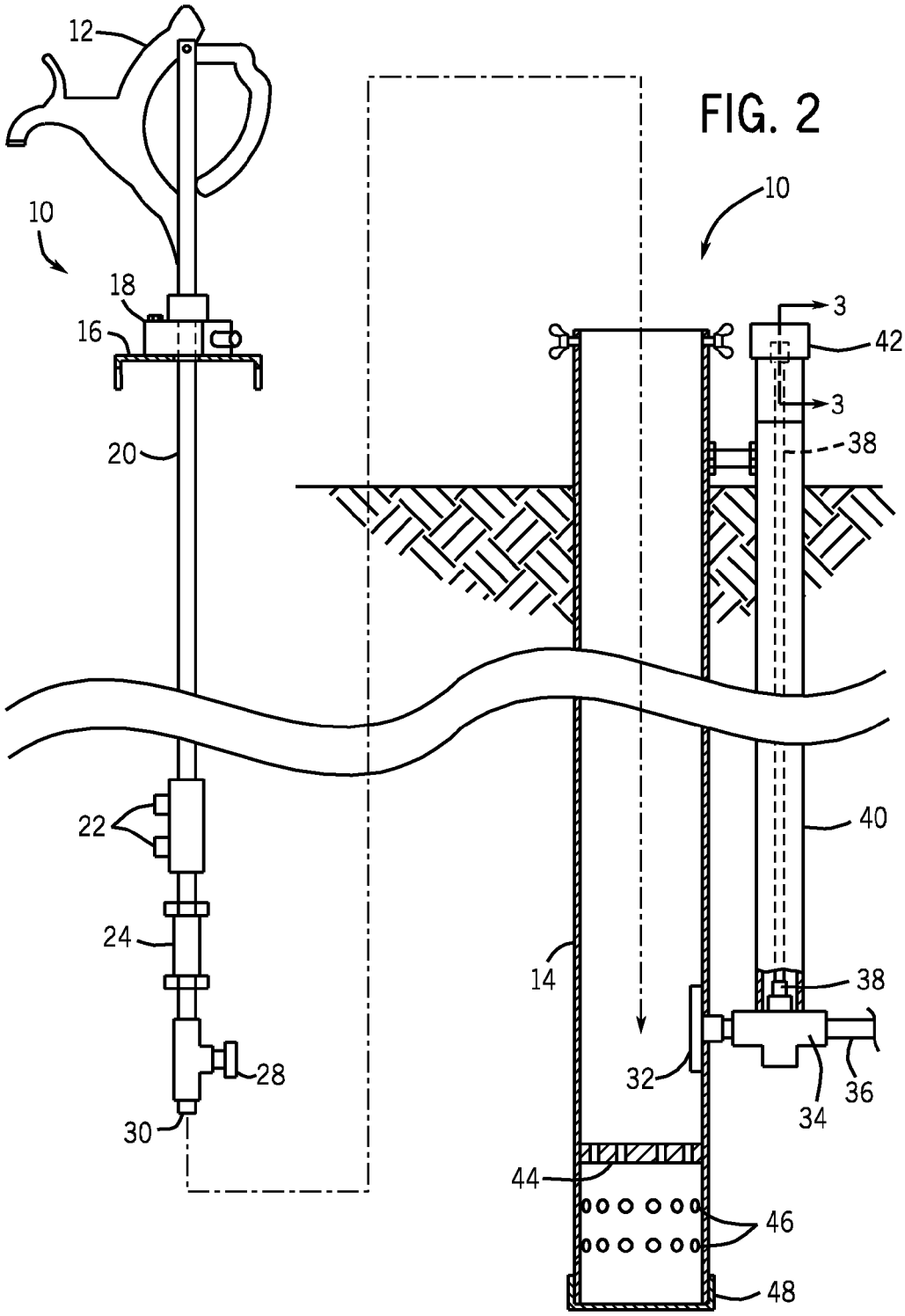
FIG. 2 is an exploded view of the Yard Hydrant Made Easy with a yard hydrant installed of FIG. 1.
Figure 3:
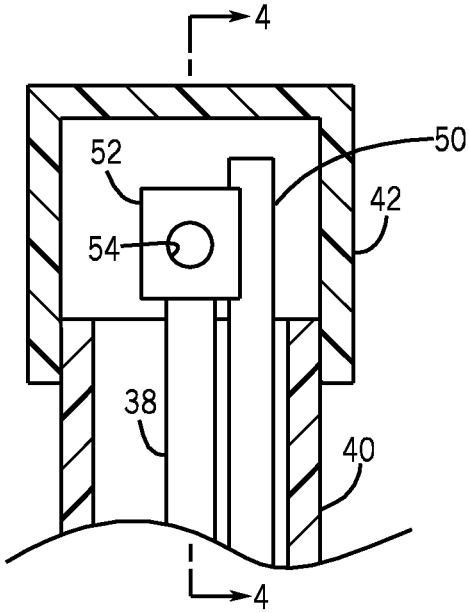
FIG. 3 is a cross-sectional view taken along line 3-3 of FIG. 1.
Figure 4:
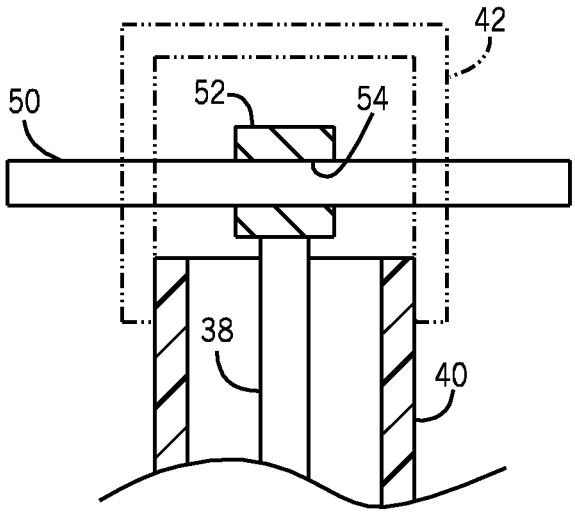
FIG. 4 is a cross-sectional view taken along line 4-4 of FIG. 3.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a Yard Hydrant Made Easy having a riser, typically a polyvinyl chloride (PVC) riser, which has a slip connection called a pitless adapter, attached directly to the side of the riser, below freeze level. The water supply is connected to the outside section of the pitless adapter and a yard hydrant is attached to the inside removable section of the pitless adapter. After being installed, the excavated area may be backfilled, leaving only the top of the riser above the ground, with a yard hydrant extending up through it. This hollow riser and slip connection allows for easy removal and replacement of a yard hydrant, without the need of any future excavation, busting of concrete, or tearing up of landscaped areas. A seepage section may be incorporated at the base of the riser, with, for example, a mesh filter material therewithin. This section allows a yard hydrant to drain out without ever coming in contact with soil. This prevents any chance of the drain hole, at the base of the yard hydrant, becoming stopped up and causing the hydrant to freeze. A dual check valve backflow preventer may be installed at the base of the hydrant, according to local plumbing codes, without the need for a separate pit. An underground shut-off valve may be connected to the outside section of the pitless adaptor to allow the individual hydrant to be isolated without interrupting water supply to an entire property.

As used herewithin, the term "Yard Hydrant Made Easy" refers to a yard hydrant system that may permit easy replacement of a yard hydrant, without the need to dig up the old hydrant or thread a new hydrant from a distance from a fitting. Other features of the Yard Hydrant Made Easy may be included in the present invention as herein described.

Referring to FIGS. 1 through 4, a Yard Hydrant Made Easy 10 may include a spigot to control the flow of water through a hydrant riser 20. A casing 14 may be placed in the ground, around the riser 20. The riser 20 may pass through an upper cap 16 of the casing 14 and be fixed in place with a clamping member 18. The clamping member 18 may prevent movement and accidental disconnection of the riser 20 from a water supply line 36.

The riser 20 may connect to a pitless adapter 26. A stationary component 32 of the pitless adapter 26 may connect to the water supply line 36 from outside the casing 14. The removable component 28 of the pitless adapter 26 may connect to the riser 20. A plug 30 may be installed in the bottom of the pitless adapter 26.

One or more optional devices may be installed between the riser 20 and the pitless adapter 26. A dual check valve backflow preventer 24 may be disposed between the riser 20 and the pitless adapter 26, as may be required by local plumbing codes.

The drain of a yard hydrant 22 is between the riser and the pitless adapter 26. The drain 22 may help prevent freezing of the yard hydrant by allowing water in the riser 20 to drain. When the dual check valve backflow preventer 24 is installed, the drain 22 is between the riser 20 and the backflow preventer 24. The water draining from the drain 22 may pass through a perforated internal cap 44 in the casing 14 and pass out through a seepage section 46 of the casing 14. An end cap 48 may be disposed on the end of the casing 14. Therefore, debris, dirt and the like may not impede the drain 22.

An underground shutoff valve 34 may be disposed between the main water line 36 and the pitless adapter 26. The shutoff valve may include a valve key 38 extending through a valve key riser 40 to extend above ground. A removable end cap 42 may cover the valve key riser 40. A head 52 of the valve key 38 may include a hole 54 for inserting a valve key handle 50. Turning the valve key handle 50 may close the underground shutoff valve 34 and isolate the yard hydrant 10 without needing to shut down additional portions of the water supply system.

Embodiments of the present invention may provide a user with the ability to replace a yard hydrant, supplied with an underground water supply, without the need of excavation. After shutting off the water with the underground shutoff valve 34, the bolts holding on the upper cap 16 of the casing 14 may be removed and the upper cap 16 may be lifted out, resulting in separation of the pitless adapter 26. The entire yard hydrant assembly (as shown disconnected in FIG. 2) may be removed and replaced. In some embodiments, replacement may include replacement of one or more of the spigot 12, the riser 20, the drain 22, and the dual check valve backflow preventer 24, for example. A new riser 20 may be threaded onto the other components while holding both components, unlike the conventional systems, which may require screwing in a new riser into a fitting disposed underground. Once the new components are installed, the pitless adapter 26 may be reassembled and the upper cap 16 affixed to the casing 14. Water may be turned on with the underground shutoff valve 34 to permit flow through the pitless adapter 26, the riser 20 and out the spigot 12.

Figure 5:
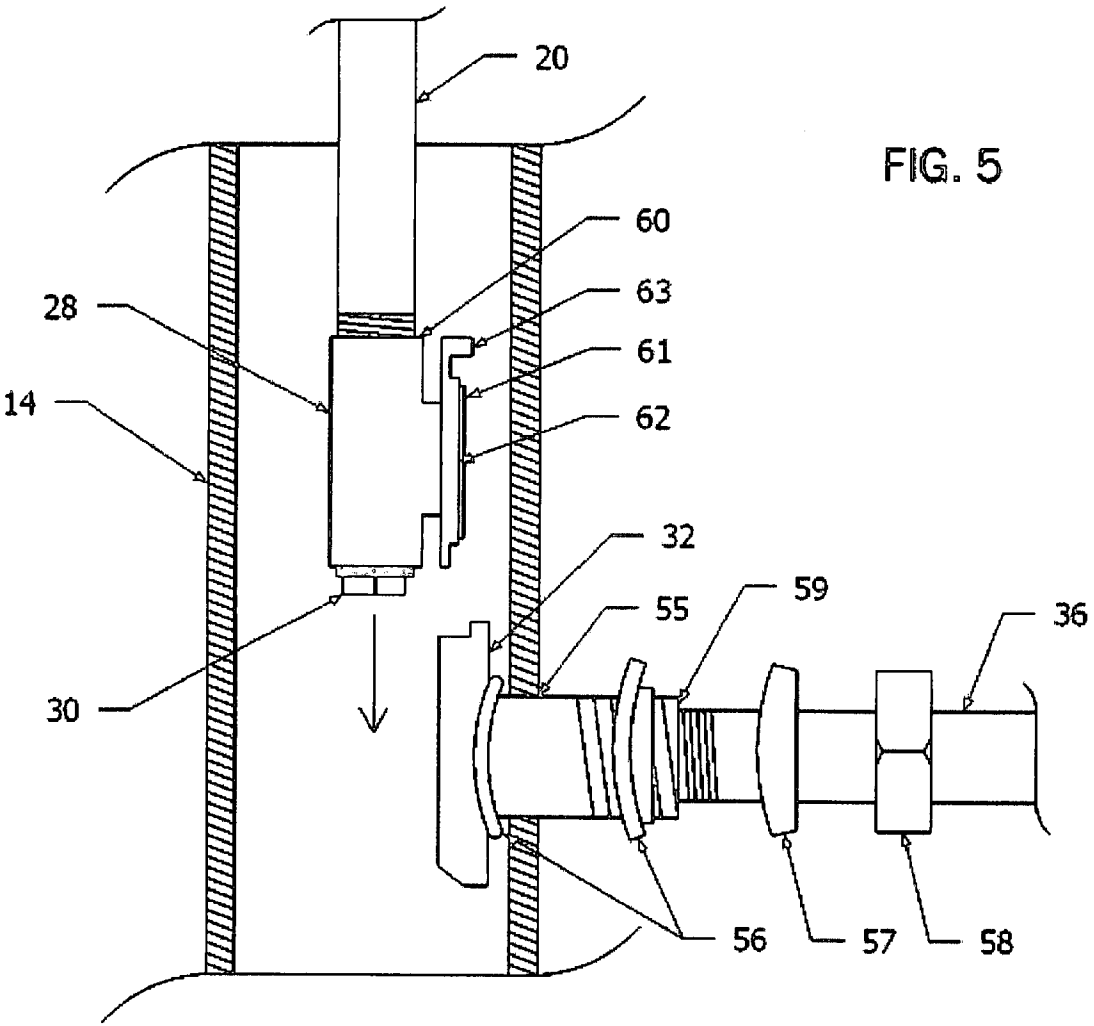
FIG. 5 is a detailed side view of the disconnected components of the slip together adapter.
Figure 6:
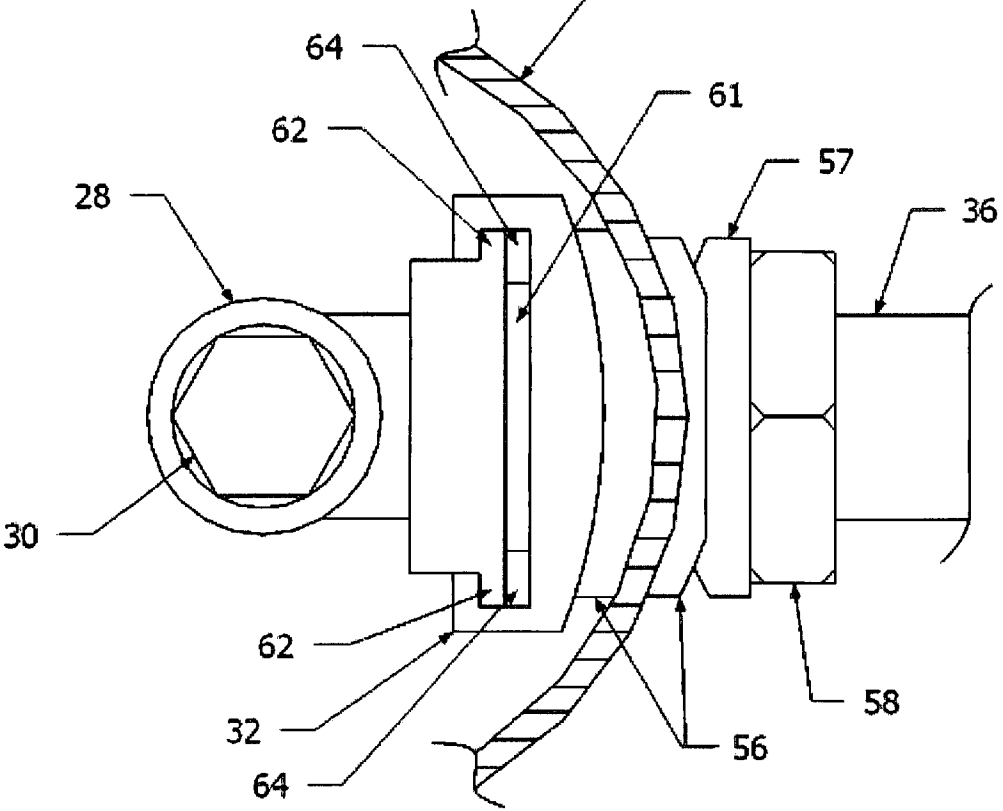
FIG. 6 is a detailed bottom view of the connected components of the slip together adapter.

Referring now to FIGS. 5 and 6, detailed views of the slip together adapter components are shown. FIG. 5 is a side view of the removable component 28 of the pitless adapter 26 separated from the stationary component 32. The removable component 28 is connected to the base of the riser 20 via an internal female pipe thread 60 opposite the plug 30. The removable component 28 has a flange 62 on one side with a central inlet opening (now shown) therein. The inlet opening in the flange 62 is surrounded by an O-ring 61 seated in a groove (not shown) surrounding the inlet opening. The flange 62 includes a stop 63 at a top edge thereof.

The stationary component 32 is attached directly to the casing 14 by drilling a hole 55 in the casing 14 and inserting the stationary component 32 through the hole 55 from inside the casing 14. Once inserted, the stationary component 32 is securely fastened to the casing 14 by internal and external gaskets 56 held tightly to the casing 14 by an external back plate 57, which is tightened by an external lock nut 58. The stationary component 32 at the lower end of the casing 14 is connected to the threaded water supply line 36, which is below freeze level, by an internal female pipe thread 59 at the exterior end of the stationary component 32. The stationary component 32 also includes a U-shaped, vertical slot 64 interior the casing 14, the slot 64 sized to accept the flange 62 of the removable component 28. As shown in FIG. 6, the flange 62 of the removable component 28 slides into the U-shaped vertical slot 64 from above, with the O-ring 61 forming a tight seal with the interior of the U-shaped vertical slot 64 of the stationary component 32. The stop 63 on the flange 62 contacts the top of the stationary component 32 to properly position the O-ring 61 around the inlet opening of the stationary component 32.

It should be understood, of course, that the foregoing relates to exemplary embodiments of the invention and that modifications may be made without departing from the spirit and scope of the invention as set forth in the following claims.

What is claimed is:

1. A yard hydrant system comprising:

a casing disposed in ground, the casing extending from a surface of the ground into the ground;

a riser adapted to be disposed in the casing, the riser including a spigot attached to a first end thereof and a drain attached to a second, opposite end thereof, the riser including a check valve backflow preventer positioned below the drain;

a pitless adapter attached below the backflow preventer, the pitless adapter having a stationary component attached to the casing, the stationary component permitting a fluid connection from outside the casing to inside the casing;

a water supply line attached to the stationary component outside the casing; and a removable component of the pitless adapter fluidly connected to the riser.

2. The yard hydrant system of claim 1, further comprising an upper end cap connected to a top portion of the casing.

3. The yard hydrant system of claim 2, further comprising a clamping member adapted to attach the riser to the upper end cap.

4. The yard hydrant system of claim 1, further comprising an underground shutoff valve between the water supply line and the stationary component of the pitless adaptor.

5. The yard hydrant system of claim 4, further comprising a valve key casing for extending a valve key from the underground shutoff valve to the surface of the ground.

6. A yard hydrant system comprising:

a casing disposed in ground, the casing extending from a surface of the ground into the ground;

a seepage section at a bottom end of the casing, the seepage section including a perforated internal cap in the casing, and perforations in the casing;

a riser adapted to be disposed in the casing;

a pitless adapter having a stationary component attached to the casing, the stationary component permitting a fluid connection from outside the casing to inside the casing;

a water supply line attached to the stationary component outside the casing; and a removable component of the pitless adapter fluidly connected to the riser.

* * * * *